US009411312B2

(12) United States Patent
Wang et al.

(10) Patent No.: US 9,411,312 B2
(45) Date of Patent: Aug. 9, 2016

(54) SILICON OVERCOIL BALANCE SPRING

(71) Applicant: Master Dynamic Limited, Shatin, New Territories (HK)

(72) Inventors: Ying Nan Wang, Shatin (HK); Ho Ching, Kowloon (HK)

(73) Assignee: Master Dynamic Limited, Hong Kong (HK)

( * ) Notice: Subject to any disclaimer, the term of this patent is extended or adjusted under 35 U.S.C. 154(b) by 77 days.

(21) Appl. No.: 14/444,918

(22) Filed: Jul. 28, 2014

(65) Prior Publication Data

US 2015/0029828 A1 Jan. 29, 2015

(30) Foreign Application Priority Data

Jul. 29, 2013 (HK) ..... 13108857

(51) Int. Cl.

*G04B 17/06* (2006.01)
*G04B 17/32* (2006.01)
*G04D 3/00* (2006.01)

(52) U.S. Cl.

CPC ..... *G04B 17/066* (2013.01); *G04B 17/32* (2013.01); *G04B 17/325* (2013.01); *G04D 3/0041* (2013.01); *Y10T 29/49579* (2015.01)

(58) Field of Classification Search

CPC .... G04B 17/066; G04B 17/32; G04B 17/325; G04B 17/345; G04D 3/00401; Y10T 29/49579
See application file for complete search history.

(56) References Cited

U.S. PATENT DOCUMENTS 469,914 A * 3/1892 Olsen ..... G04B 17/063 368/175
570,394 A * 10/1896 Griscom ..... G04B 17/066 368/175
3,958,410 A * 5/1976 Bell ..... G04C 3/061 310/36

(Continued)

FOREIGN PATENT DOCUMENTS

CH 703272 A2 12/2011
CH 703337 A2 12/2011

OTHER PUBLICATIONS

Machine translation of CH703272, retrieved from the internet Dec. 27, 2015.*

(Continued)

*Primary Examiner* — Vit W Miska
(74) *Attorney, Agent, or Firm* — Kolisch Hartwell, P.C.

(57) ABSTRACT

A method of producing unitary formed silicon balance spring having an overcoil portion for regulation of a mechanical timepiece, said method including the steps of providing a silicon balance spring having a main body portion, and an outer portion for formation as an overcoil portion, wherein the outer portion extends radially outward from an outermost turn of the main body portion, and wherein said main body portion and said outer portion are integrally formed from a silicon based material and are formed in a co-planar configuration; moving said outer portion in a direction relative to and out of the plane of said main body portion, and in a direction towards over said main body portion and towards the plane of the main body portion; and providing a stress relaxation process to the balance spring so as to relieve internal stresses induced within the balance spring from step (ii); wherein upon movement of said outer portion into the plane of said main body portion, the outer portion is located in an overcoil configuration relative to said main body portion.

12 Claims, 11 Drawing Sheets

(56) References Cited

U.S. PATENT DOCUMENTS

| | | | | |
|---|---|---|---|---|
| 7,950,847 | B2 * | 5/2011 | Zaugg | G04D 3/0041 216/2 |
| 8,296,953 | B2 | 10/2012 | Bühler et al. | |
| 2009/0245030 | A1 * | 10/2009 | Buhler | G04B 17/066 368/177 |
| 2010/0110840 | A1 * | 5/2010 | Zaugg | G04D 3/0041 368/177 |
| 2011/0199866 | A1 * | 8/2011 | Zaugg | G04D 3/0041 368/177 |

OTHER PUBLICATIONS

U.K. Intellectual Property Office, "Search Report Under Section 17" in connection with related Application No. H600088, dated Dec. 17, 2013, 2 pages.

European Patent Office, "Communication Pursuant to Article 94(3) EPC" in connection with related European Patent Application No. 14178831.5, dated Apr. 25, 2016, 5 pages.

European Patent Office, "Extended European Search Report" in connection with related European Patent Application No. 14178831.5, dated Jul. 31, 2015, 5 pages.

* cited by examiner

SILICON OVERCOIL BALANCE SPRING

TECHNICAL FIELD

The present invention relates to a silicon based overcoil balance spring. In particular, the present invention relates a silicon overcoil spring and the method of manufacturing the same.

BACKGROUND OF THE INVENTION

The regulating assembly of a timepiece typically includes a balance wheel which is an inertia flywheel, and a balance spring which is a resonator. These two components determine the working quality and accuracy of a timepiece. The resonant frequency of the balance spring and the balance wheel system control the working and regulation of the timepiece movement.

The use of silicon as a material for fabrication of a balance spring is known in the art of watch springs. The ultrahigh fabrication precision of such fabrication processes, owing to the progress developed by the IC industry, offers high precision of a balance spring's dimensions. Further, silicon is a non-magnetic material, which provides advantages in timepiece manufacturing.

It is known that the coils of a plane balance spring deform eccentrically when the balance spring is in operation, which causes the centre of gravity of the balance spring to not correspond to the centre of the rotation of the balance wheel and the balance spring. This alters the setting of the balance wheel and the balance spring, and causes anisochronous motion.

Although the centre of gravity of the balance spring could be returned arbitrarily to the centre by being shifted, this does not address this disadvantage. As during the working of a balance spring the centre of the gravity would move, this would therefore no longer coincide with the initial centre of gravity.

Different solutions have been proposed in the prior art to reduce the above disadvantage and to so as to make the deformations of the balance spring coils less non-concentric.

Examples of such prior art include:

(i) the Breguet overcoil balance spring with a so-called Philips curve in which an outer curve is lifted into a second plane above the balance spring, and (ii) the Straumann double balance springs in which two balance springs manufactured as a matched pair are arranged so that they oscillate against one another, with a view to cancelling or reducing such effects.

The first example (i) is directed to modifying the initial plane balance springs so that it becomes a balance spring occupying a plurality of planes. Breguet has manufactured a Breguet overcoil balance spring with silicon based material, whereby the balance spring is formed from two or more pieces as an assembled overcoil spring.

The second example (ii) consists of two balance springs which are manufactured as a matched pair. They are arranged so that they oscillate against one another such that the centres of gravity of the two springs move outwards and inwards on opposing symmetrical paths as they oscillate, with a view having the cumulative centre of gravity of the two springs remain towards the centre of the arbor. As there are two balance springs in this oscillating system, this however results in more energy consumption.

OBJECT OF THE INVENTION

The present invention seeks to provide a balance spring which overcomes or minimizes at least some of the deficiencies as exhibited by those of the prior art.

SUMMARY OF THE INVENTION

In a first aspect, the present invention provides a method of producing unitary formed silicon balance spring having an overcoil portion for regulation of a mechanical timepiece, said method including the steps of:

(i) providing a silicon balance spring having a main body portion, and an outer portion for formation as an overcoil portion, wherein the outer portion extends radially outward from an outermost turn of the main body portion, and wherein said main body portion and said outer portion are integrally formed from a silicon based material and are formed in a co-planar configuration;

(ii) moving said outer portion in a direction relative to and out of the plane of said main body portion, and in a direction towards over said main body portion and towards the plane of the main body portion; and (iii) providing a stress relaxation process to the balance spring so as to relieve internal stresses induced within the balance spring from step (ii);

wherein upon movement of said outer portion into the plane of said main body portion, the outer portion is located in an overcoil configuration relative to said main body portion.

The movement of said step (ii) may be effected incrementally in the direction towards over said main body portion and towards the plane of the main body portion. Between or during incremental steps of step (ii), the step (iii) may be effected.

Preferably an oxidation step of at least the outer portion is effected prior to effecting step (ii), so as to remove or minimize stress concentration defects. Preferably, the oxidation step includes exposure to a hydrogen fluoride solution.

The method may include the step of twisting the outer portion through at least one 180° turn, wherein said at least one 180° turn is about the longitudinal axis of said outer portion, and where the outer portion is twisted in a region adjacent the outer turn of said main body portion.

Preferably the stress relaxation process is performed at a temperature of greater than 500° C., more preferably at a temperature of greater than 700° C., and more preferably at a temperature of greater than 1100° C.

Preferably the stress relaxation process is performed for at least 10 hours, more preferably for at least 20 hours, and more preferably for at least 30 hours.

Preferably the balance spring is formed by way of a microfabrication technique, more preferably by way of a deep reactive ion etching (DRIE) technique.

In a second aspect, the present invention provides a unitary formed silicon balance spring having an overcoil portion, when formed according to the first aspect.

Preferably the balance spring is sized for a timepiece.

In a third aspect, the present invention provides a silicon based balance spring comprising:

a main body portion of a having a spring arrangement for providing restoration torque for regulation of a mechanical timepiece, and an overcoil portion wherein the overcoil portion extending in direction relative to and out of the plane of said main body portion, and in a direction towards over said main body portion and towards the plane of the main body portion;

wherein said main body portion and said overcoil portion are unitary formed.

Preferably the balance spring is formed by way of a micro-fabrication technique, and more preferably by way of a deep reactive ion etching (DRIE) technique.

BRIEF DESCRIPTION OF THE DRAWINGS

Preferred embodiments of the present invention will be explained in further detail below by way of examples and with reference to the accompanying drawings, in which.

DETAILED DESCRIPTION OF THE DRAWINGS

Figure 1A:
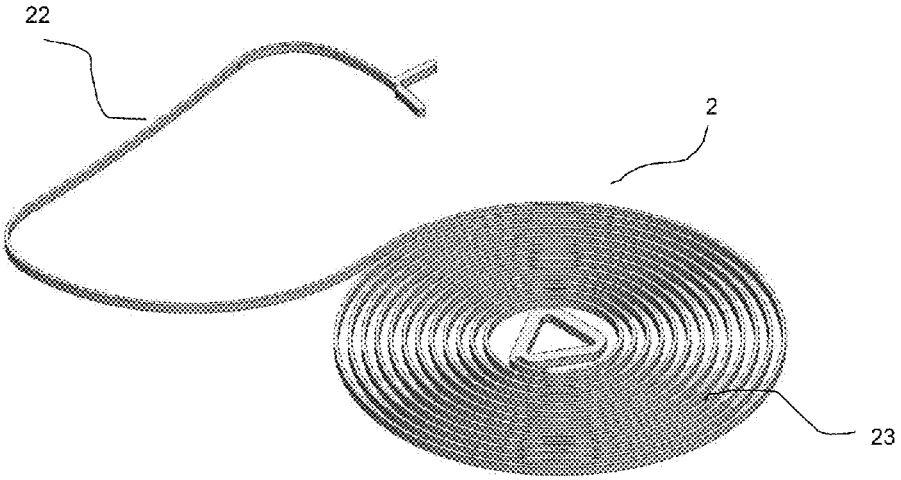
FIG. 1*a* and FIG. 1*b* depict a perspective and a top view of an embodiment of a balance spring in accordance with the present invention prior to formation of an overcoil arrangement.

The present invention provides a planar silicon balance spring having a main body and an integrally formed overcoil portion so as to improve concentricity and isochronicity of such a spring when utilized in a timepiece.

The balance spring includes an overcoil portion which achieves said improvement in concentricity and isochronicity which is integrally formed with the main body of the balance spring and extends from the periphery of the main body of the balance spring in an out of plane overcoil arrangement, and manufacturing process for the formation thereof.

The present invention provides a method of manufacturing an overcoil balance spring, whereby the balance spring is formed from a silicon based material, which provides a unitary formed silicon overcoil balance spring, without the necessity of any connection unit, as required by the previously mentioned silicon overcoil balance spring made by Breguet, U.S. Pat. No. 7,950,847.

In accordance with the present invention, a balance spring is provided and unitary formed from a silicon based material, whereby the balance spring includes a main body portion and overcoil portion.

The balance spring is initially formed and provided with all portions in a co-planar form, and is formed by micro-manufacturing techniques, including Photo Lithography and Deep reactive-ion etching (DRIE), whereby the main body portion, collet portion and overcoil portion are co-planar.

Utilising techniques and processes in accordance with the present invention as described below and as described in reference to the accompanying drawings, the overcoil portion is provided out of the plane and in accordance with overcoil portions of balance springs as utilized for increasing balance spring concentricity, whilst not comprising the mechanical integrity of the balance spring and without the necessity for a separate overcoil portion to be adjoined to the main body portion.

In accordance with the present invention, the shape and configuration of portions of the balance spring may be modified by utilising thermal techniques, without compromising the requisite mechanical properties of the balance spring as required during use in a time piece.

In the present invention, there is provided a method for producing a unitary formed silicon balance spring having an overcoil portion and a spring resulting therefrom, whereby a balance spring is initially formed having a main body portion for providing restoration torque for regulation of a mechanical timepiece, and an outer portion for formation of an overcoil portion wherein the outer portion extends radially outward from an outermost turn of the main body portion. The main body portion and the outer portion are integrally formed from a silicon based material and are formed in a co-planar configuration.

The outer portion is moved in a direction relative to said main body portion and out of the plane of said main body portion, and in a direction towards over said main body portion and towards the plane of the main body portion.

A stress relaxation process is provided to the balance spring so as to relieve internal stresses induced within the balance spring, and upon movement of said outer portion into the plane of said main body portion, the outer portion is located in an overcoil configuration relative to said main body portion.

Embodiments and examples of the present invention are described as follows.

Figure 1B:
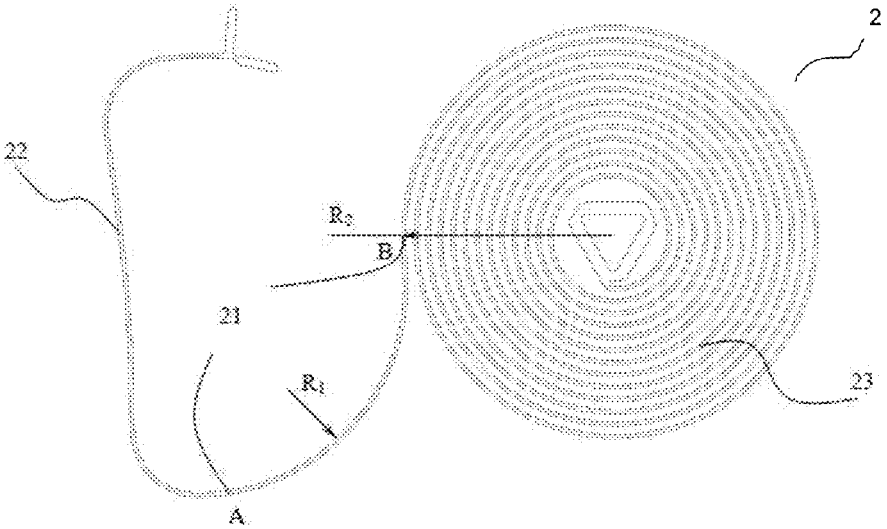
Figure 2A:
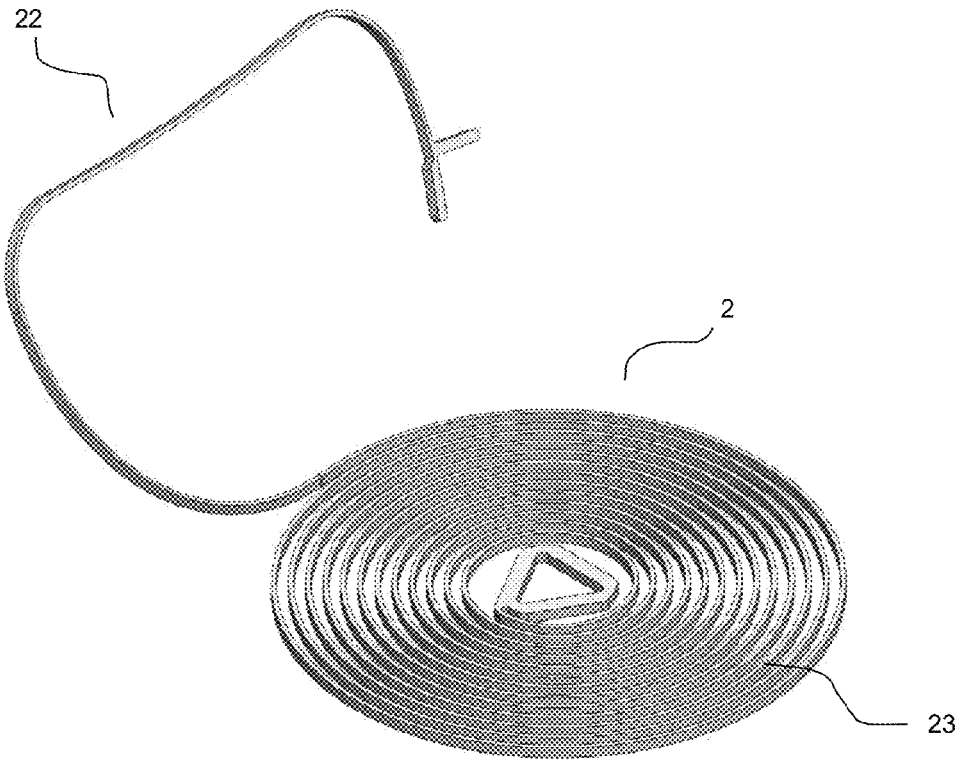
FIG. 2*a* and FIG. 2*b* depict a perspective view and a side view of the embodiment of a balance spring of FIG. 1*a* and FIG. 1*b* with an overcoil arrangement partly configured.
Figure 2B:
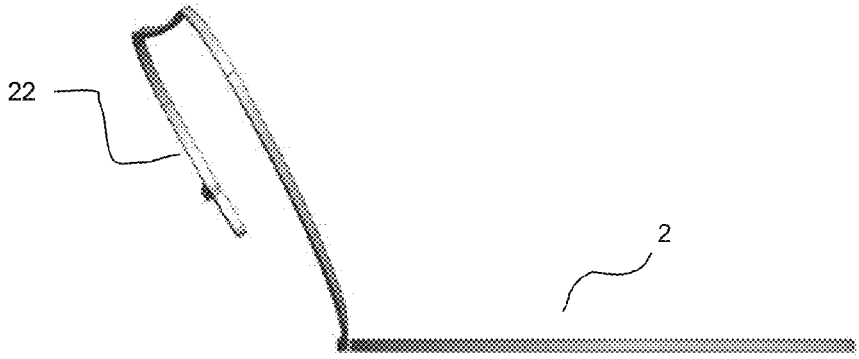
Figure 3A:
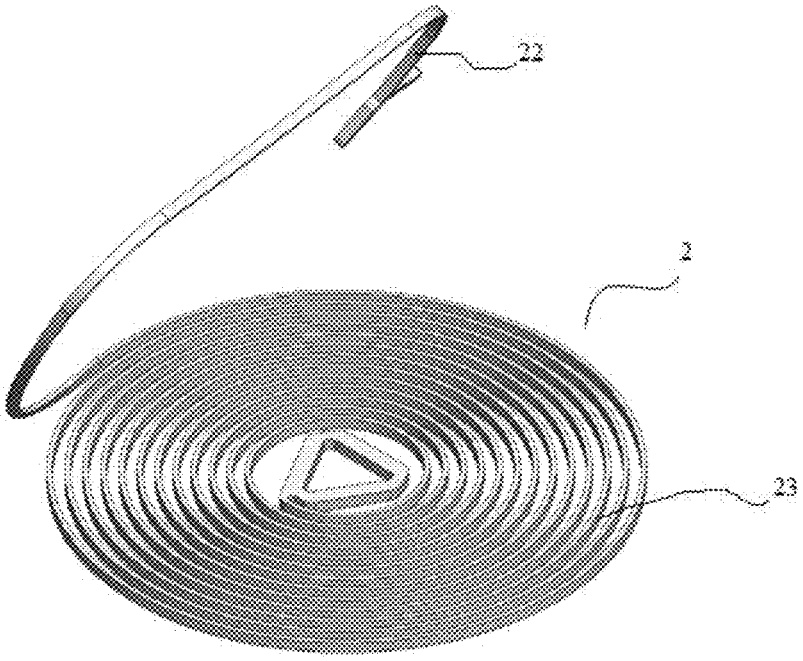
FIG. 3*a* and FIG. 3*b* depict a perspective and a side view of the embodiment of a balance spring of FIG. 2*a* and FIG. 2*b* with the overcoil arrangement further partly configured.
Figure 3B:
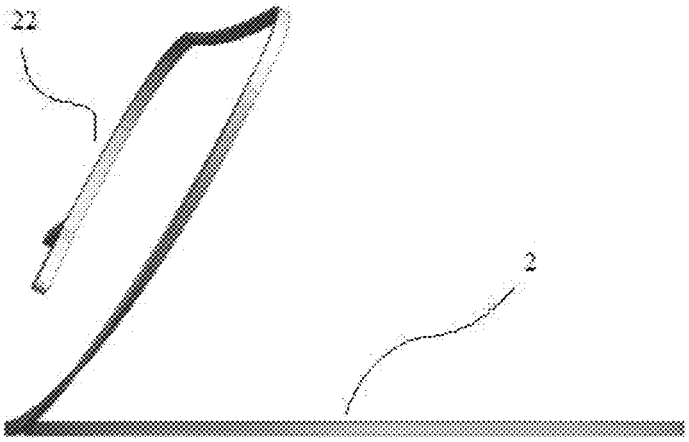

Referring to the embodiment as depicted in FIG. 1*a*-FIG. 4*b*, as shown in FIG. 1*a* and FIG. 1*b* a balance spring (2) having a main body portion (23) and an outer portion (22) prior to formation of an overcoil portion by a twisting movement is shown, and which has a "C" shape twisting region (21), whereby balance spring (2) is provided in an initial planar configuration and the outer portion (23) and main body portion (23) are integrally formed from a single material and are co-planar. The radius of the twisting region $R_1$ is slightly less than that of the second most outer coil $R_2$. This design helps the twisting region (21) of final overcoil balance spring to follow the spiral of Archimedes, as seen from the top view.

As shown in FIG. 2*a*, FIG. 2*b*, FIG. 3*a*, FIG. 3*b*, FIG. 4*a* and FIG. 4*b* there is shown the shape change of the balance spring (2) to form an overcoil portion, whereby the shape change which is effected to form the overcoil portion by moving said outer portion (22) in a direction relative to and out of the plane of said main body portion (23), and in a direction towards over the main body portion (23) and towards the plane of the main body portion (23), causing twisting the outer portion (22) away from the plane of said main body portion (23) step by step.

Figure 4A:
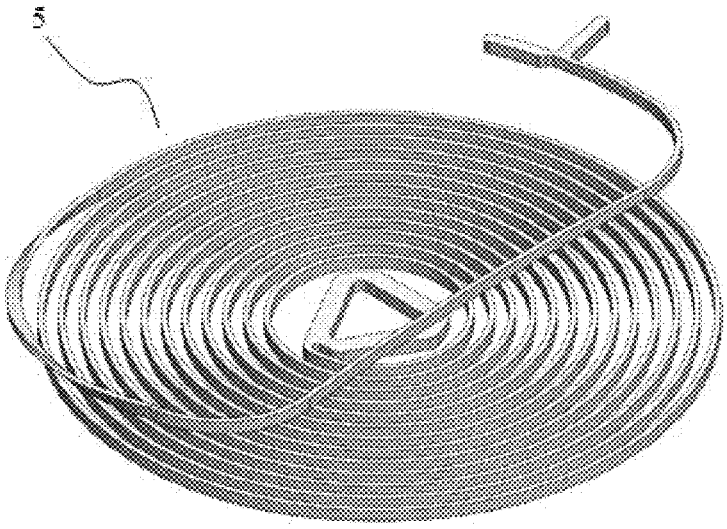
FIG. 4*a* and FIG. 4*b* depict a perspective and a top view of the embodiment of the balance spring of FIG. 1*a* to FIG. 3*b* with the overcoil arrangement fully configured.
Figure 4B:
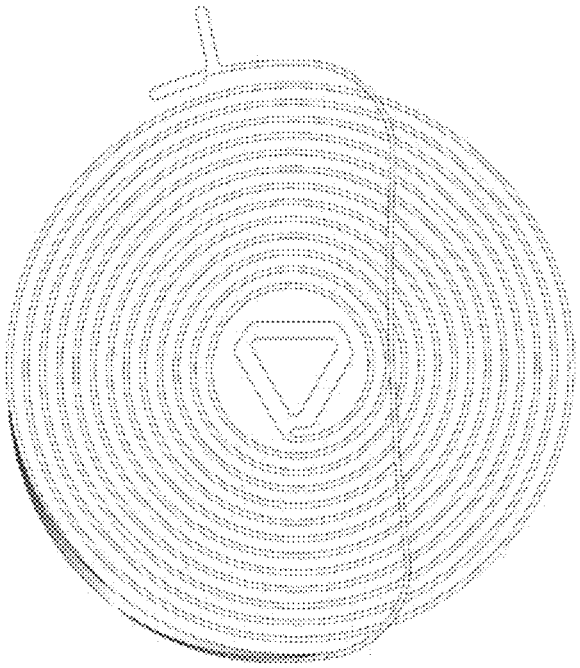
Figure 5:
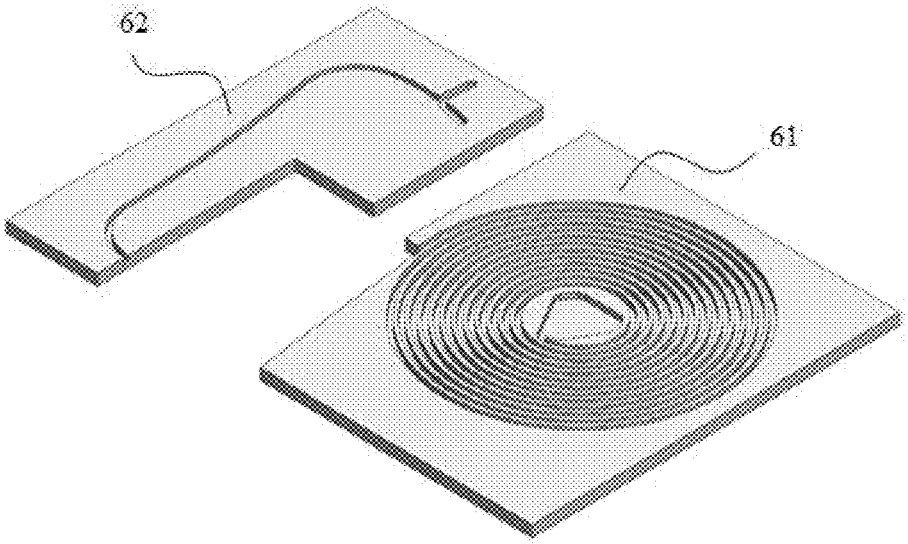
FIG. 5, FIG. 6, FIG. 7, FIG. 8 and FIG. 9 depict formation of the balance spring of FIG. 1*a* to 4*b;*

The shape of the original balance spring (2) as depicted transforms to an overcoil balance spring after the outer portion (22) being moved towards the plane of the body of the spring as depicted in FIG. 4*a* and FIG. 4*b*, whereby the outer portion (22) has formed an the overcoil portion by being been twisted 180° with respect to the adjacent the outermost turn of the main body of the spring.

Other geometries of balance springs in accordance with the present invention are discussed below in relation to other embodiments.

Referring to FIGS. 5 to 9, there is depicted the manner in which the balance spring of FIGS. 1*a*-4*b* may be manipulated in accordance with the present invention, so as to provide a unitary formed overcoil balance spring.

To achieve the movement and twisting process of the balance spring (2), it is necessary to utilize holders (61, 62) to grip the main body portion (23) and the outer portion (22). In the present embodiment, the outer portion (22) of the balance spring (2) needs to be flipped 180°, and this process requires high positioning accuracy.

For this embodiment design, there are provided two holders needed for maintaining the positional accuracy, as shown in FIGS. 5 to 9. The first holder (61) is for holding all the centre coils of the main body portion (23) of the balance spring (2) except for the outer portion (22) including the outer portion as a "C" shape twisting region (21), and the second holder (62) is for holding the outer portion (22) of the balance spring (2).

In the present embodiment, both of holders (61, 62) are formed from silicon by DRIE, and are oxidized by thermal oxidation. The first holder (61) for holding the centre coils of the main body portion (23) of the balance spring (2) is made with a series of trenches that are almost identical to the coils of the main body portion (23) of the balance spring (2). The trench is provided with a width that is slightly larger than the line width of the balance spring coil. This assists the balance spring centre coils of the main body portion (23) to maintain their original shape when torque is applied on the twisting region (21).

The second holder (62) for holding the outer portion (22) is also provided with a trench sized so as to accommodate the coil outer portion. The same treatment as the first holder (61) applies on the second holder (62).

Figure 6:
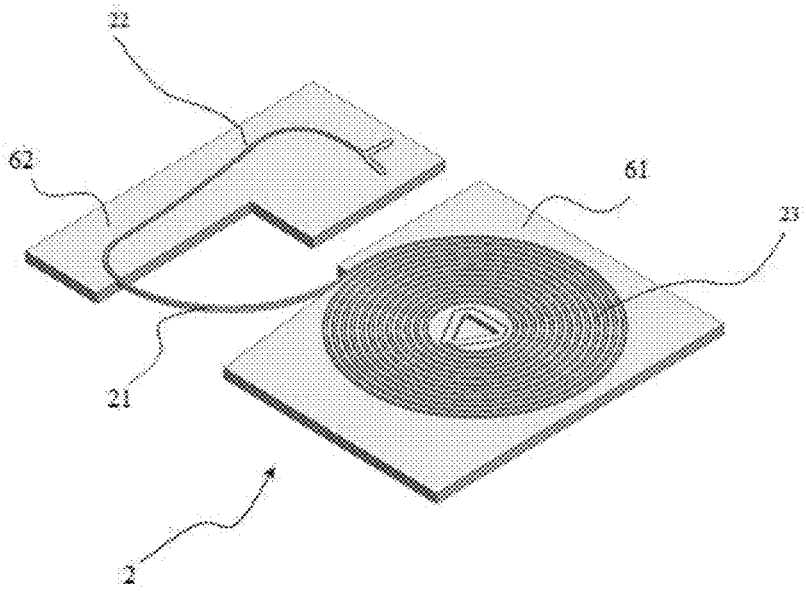

During the movement process, all the turns except for the twisting region (21) need to be fixed by holders. The centre coils of the main body portion (23) and the outer portion (22) of the balance spring (2) are fitted into the first holder (61), and the second holder (62) respectively, as shown in FIG. 6, then the balance spring is moved as described in accordance with the present invention.

Figure 7:
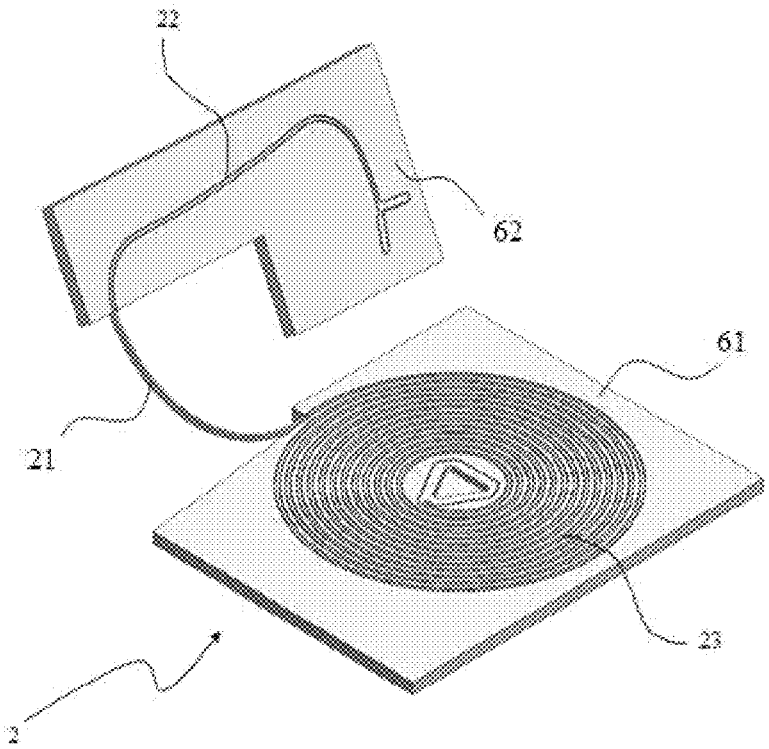
Figure 8:
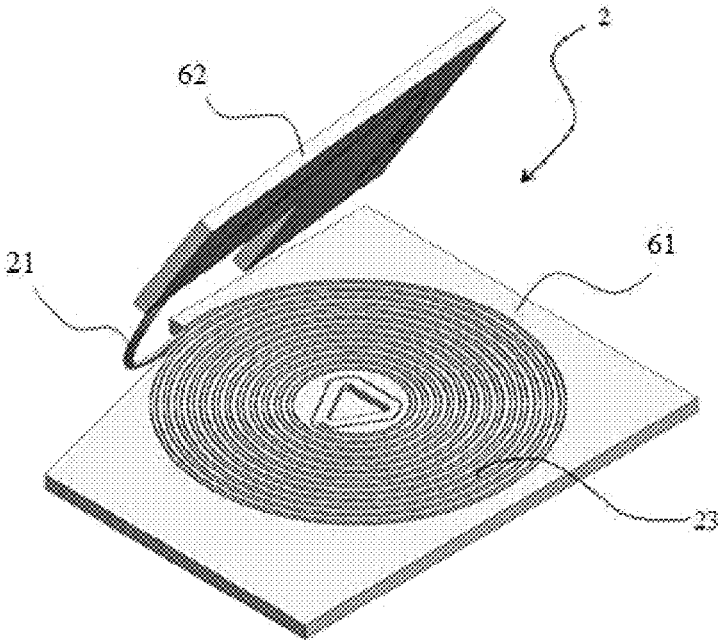
Figure 9:
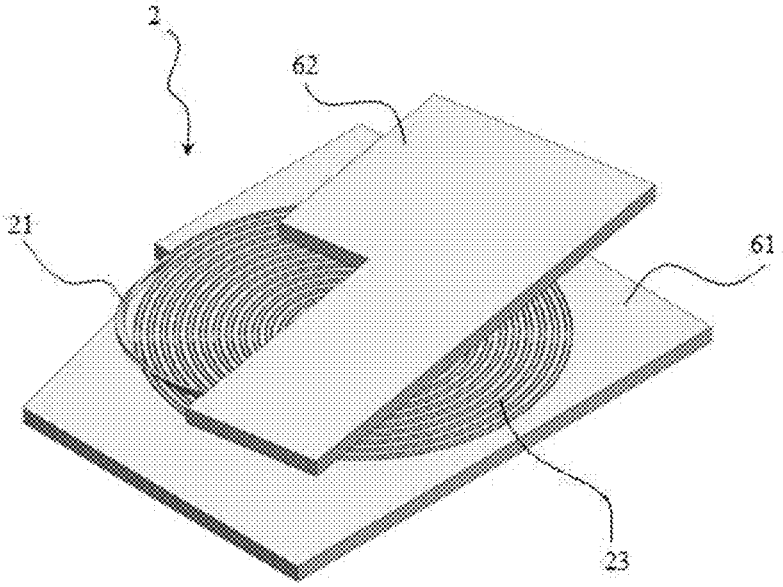

FIGS. 6, 7, 8 and 9 progressively depict the movement process of formation of the overcall portion. After the balance spring is moved into the overcoil shape as shown in FIG. 9, it is transferred into the annealing furnace together with the holders.

To achieve an overcoil balance spring with low internal stress, high temperature and long duration annealing is preferred. If the samples are put in a furnace without $N_2$ or Ar protection, the temperature should be lower than the oxidation temperature of silicon to avoid adhesion of the balance spring to the holders, and a temperature of 800° C. is applicable for this application. After cooling, the original balance spring (2) is provided as an overcoil balance spring.

For different balance spring dimensions and sizes, there may be some cases when the twisting region (21) of the balance spring (2) cannot afford a large twisting angle. In such cases, the annealing process may be provided in incremental steps with movement of the outer portion of the balance spring being in several steps.

After locating the balance spring (2) into the two holders (61, 62), as shown in FIG. 6, the balance spring outer portion (22) is twisted for 60°, as shown in FIG. 7, and then is annealed utilizing annealing conditions discussed below.

After the first annealing, the balance spring (2) changes into a twisted formation, as shown in FIG. 2. A second twisting for another 60° is then applied on the twisted balance spring (2), as shown in FIG. 7, and is annealed subsequently.

This annealing process results in a further twisted balance spring (2), as shown in FIG. 2, The final twisting for the rest 60° is performed on the twisted balance spring (2) after the previous two annealing processes, as shown in FIG. 8.

Then the balance spring (2) and the holders (61, 62) are transferred into the furnace for the finale annealing. After removing the holders (61, 62), the silicon balance spring (2) transforms into overcoil balance spring permanently.

Silicon is a brittle material at room temperature, however at temperatures between 520° C. to 600° C. the transition from brittle to ductile behaviour is obeyed. At temperatures higher than 700° C., it has been found that a requisite amount of plastic deformation is possible.

Whilst the present embodiment describes incremental movement of the outer portion over the main body portion, this may be continuous movement in other embodiments, which may include incremental or continuous heat treatment.

In accordance with the present invention and in reference to the above embodiments and equally as applicable to other or alternate embodiments such as those as described with reference to FIGS. 11*a*-12*d* below, a silicon balance spring is prepared prior to the oxidation process of the DRIE (deep reactive ion etching) etched silicon balance spring (2), the outer portion of the balance spring is twisted to another plane, and fixed by using a quartz fixture.

The oxidation temperature is preferably about 1100° C., and the temperature is kept fixed for approximately 30 hours. After the oxidation process it has been demonstrated that the shape of the outer portion of the balance spring is altered to the pre-set shape by the quartz fixture.

In order to confirm that the shape change is not due to the oxide layer, the balance spring was immersed in a Hydrogen Fluoride (HF) solution. When the oxide layer was removed from the balance spring surface, the shape of the balance spring remained the same as when oxidized.

Accordingly, it may be demonstrated that the crystal structure changes during the oxidation process, which results in the permanent shape change.

In reference to stresses induced during the movement and twisting of the outer portion of the balance spring, the following calculations are demonstrative of the mechanics and stresses.

To simplify the calculation on twisting angle and shear stress, the outer portion of the balance spring to be twisted is to be regarded as a straight beam, with beam width of t and h, and beam length l.

The twisting angle $\Phi$ is a function of the shear modulus, the polar moment inertia $I_p$ applied torque on the beam $M_t$, and the beam length l. We have $\Phi=M_t \cdot l/G \cdot I_p$ The max shear stress in the beam during the twisting is $\tau=3M_t/h \cdot t_2$.

The relationship between $\Phi$ and $\tau$ can then be found, $\tau=3\Phi \cdot G \cdot I_p/l \cdot h \cdot t^2$.

For a beam with rectangular cross section, the polar moment inertia is $I_p=K\cdot h\cdot t^3$, where K is a constant related to the ratio of h/t.

We have $\tau=3K\cdot\Phi\cdot G\cdot t/l$, take the example of h=2.5 t=100 μm, l=5 mm, G=69 GPa, we have K=0.249.

Thus, for the given parameter of the beam, the max stress is $\tau T=400\Phi$) (MPa).

For a twisting angle of 180°, the maximum stress inside the balance spring coil is about 1.3 GPa. According to Pearson at al. (Volume 5, Issue 4, April 1957, Pages 181-191), the fracture stress for thin silicon rods in room temperature is about 3 GPa.

Further, the silicon torsional scanning mirror made by IBM (*IBM J. RES. DEVELOP* VOL. 24, NO. 5 September 1980, Pages 631-637) also proves that thin silicon rods can afford large fracture stress, as were made and tested by researchers, and found that this value is so the balance spring is strong enough to afford a twist of 180°.

Preferably, prior to effecting movement/twisting of the outer portion of the balance spring, an oxidation treatment is utilized.

During the oxidation, oxygen atoms penetrate the previously formed oxide layer to react with the silicon atoms so as to form silicon oxide. At sharp corners of the balance spring, the penetration occurs more easily due to the relatively larger surface area, and thus results in thicker oxide layer, which makes the interface of silicon and silicon oxide to be smooth.

Figure 10:
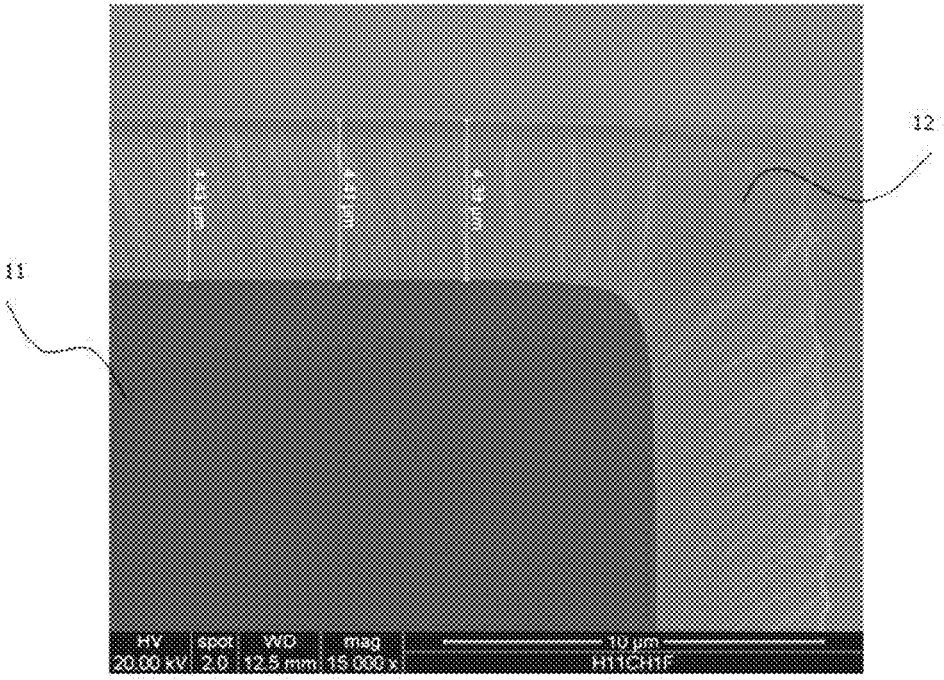
FIG. 10 depicts an SEM representation of a cross sectional view of a coil turn of a balance spring in accordance with the present invention.
Figure 11A:
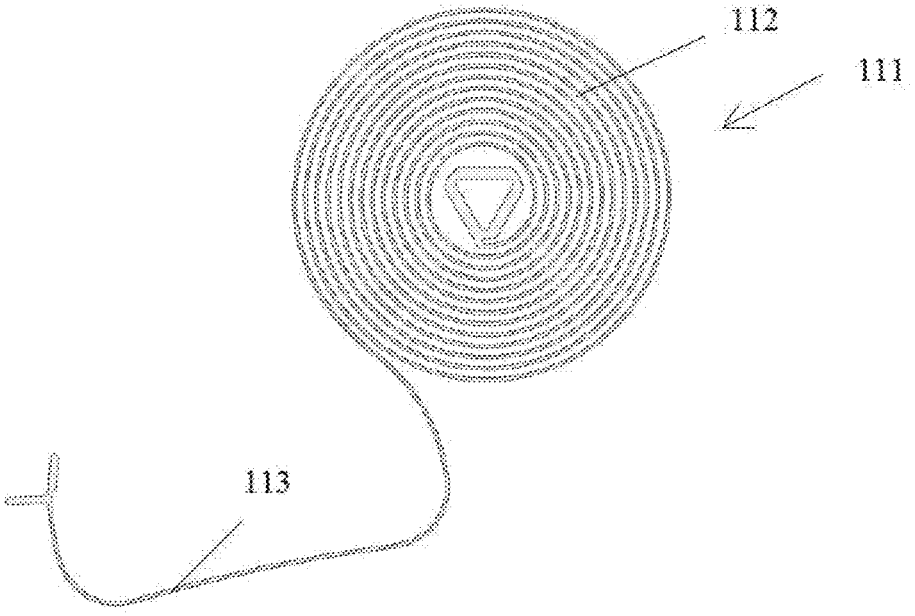
FIG. 11*a* depicts a top view of a further embodiment of a balance spring in accordance with the present invention prior to formation of an overcoil arrangement.
Figure 11B:
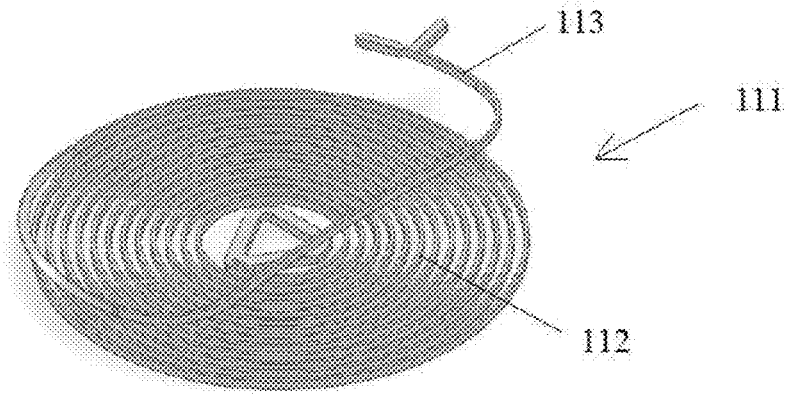
FIG. 11*b* depict a perspective view of the embodiment of a balance spring of FIG. 11*a* with an overcoil arrangement partly configured.
Figure 11C:
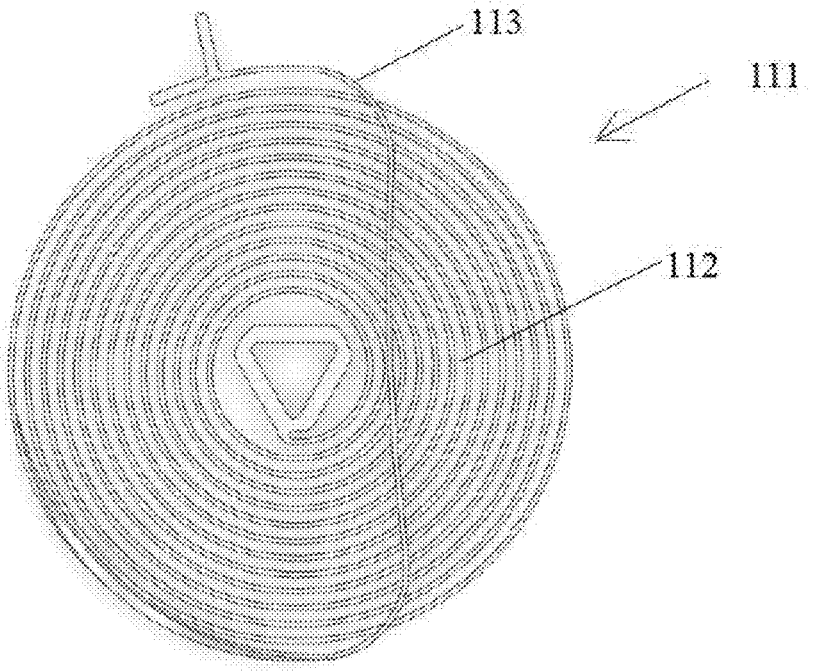
FIG. 11*c* and FIG. 11*d* depict a top view and an end view of the embodiment of the balance spring of FIG. 11*a* to FIG. 11*b* with the overcoil arrangement fully configured.
Figure 11D:
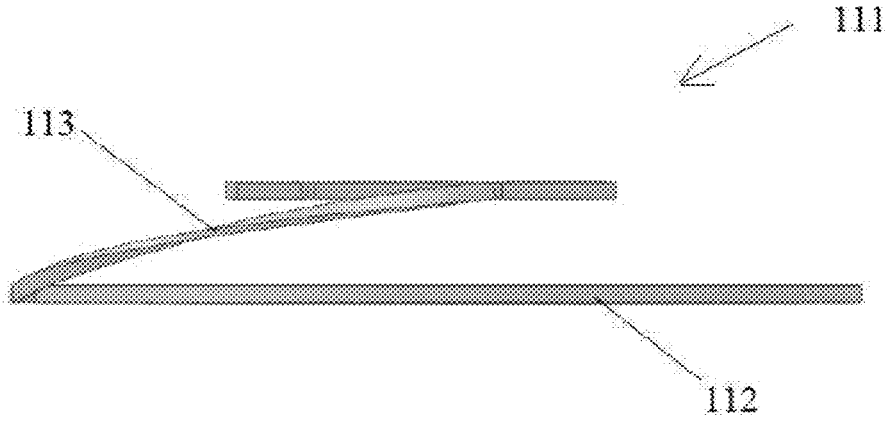
Figure 12A:
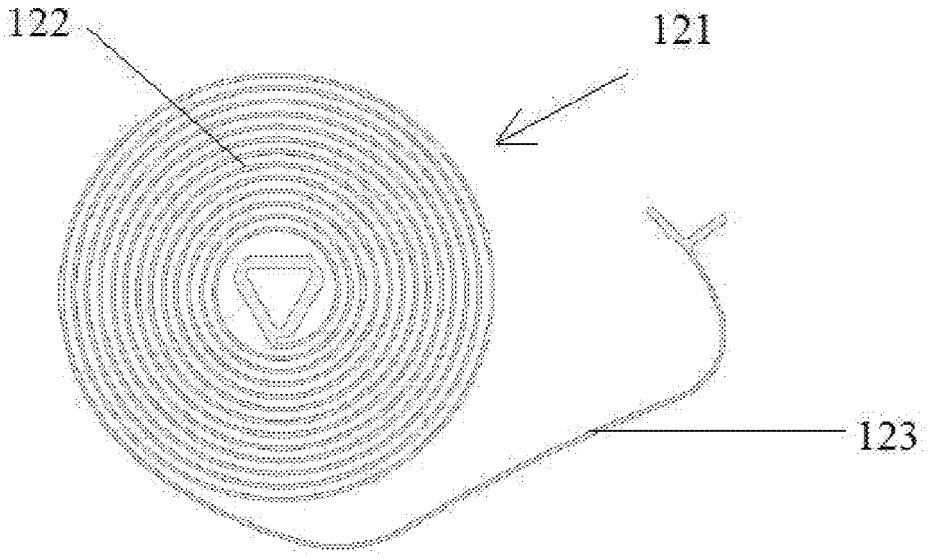
FIG. 12*a* depicts a top view of another embodiment of a balance spring in accordance with the present invention prior to formation of an overcoil arrangement.
Figure 12B:
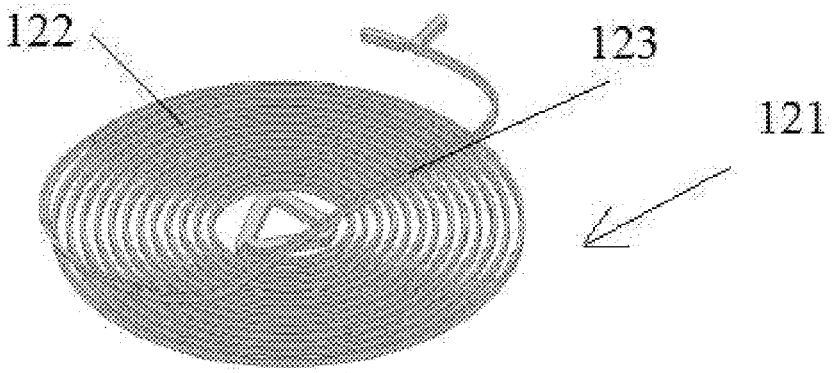
FIG. 12*b* depict a perspective view of the embodiment of a balance spring of FIG. 12*a* with an overcoil arrangement partly configured.
Figure 12C:
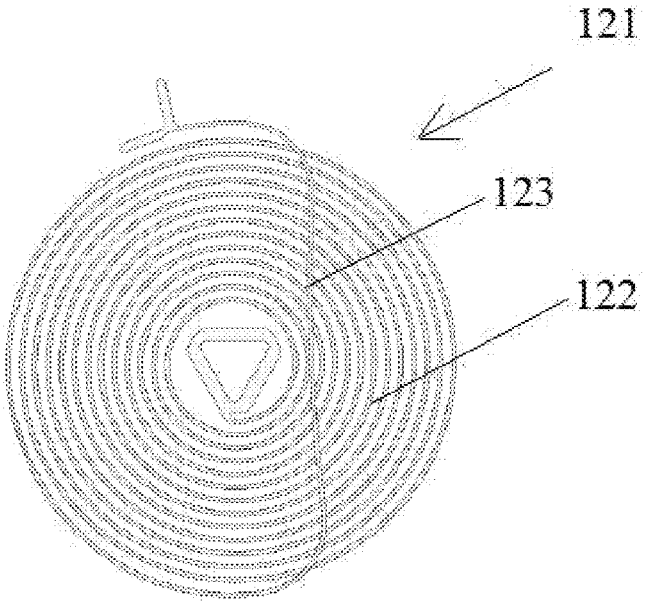
FIG. 12*c* and FIG. 12*d* depict a top view and an end view of the embodiment of the balance spring of FIG. 12*a* to FIG. 12*b* with the overcoil arrangement fully configured.
Figure 12D:
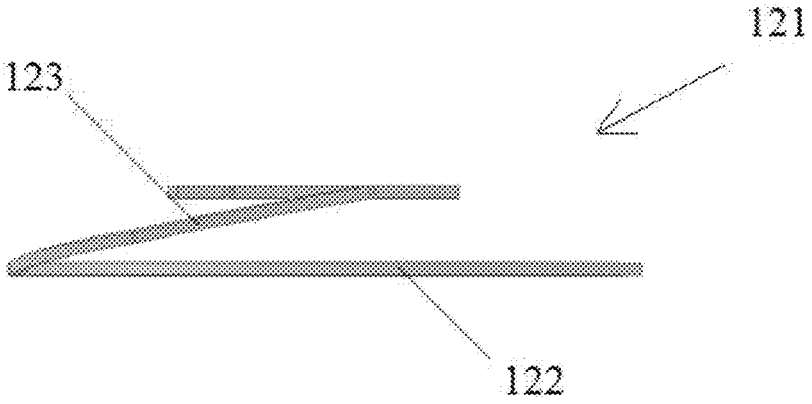

When dipped into HF solution, the initial sharp corners of the silicon balance spring are removed with the oxide layer, as can be seen in the SEM image of the cross section of the oxidized silicon balance spring in FIG. 10.

As can be seen where (11) is the silicon core, (12) is the oxide layer, the sidewall roughness has been greatly reduced, and the corner of the cross section has been rounded.

The oxidation process performed before the large angle twisting can remove the defects resulted from the DRIE process, as well as the sharp corners of the cross section, which makes the balance spring more durable due to reduction in stress concentrations.

Referring to FIGS. 11*a*-11*d* there is shown and described a further embodiment of the present invention, and with reference to FIGS. 12*a*-12*d* there is shown and described another embodiment of the present invention.

FIGS. 11*a*-11*d* show a further embodiment of a balance spring (111) having a main body portion (112) and an outer portion (113). This embodiment is similar to that of FIGS. 1*a*-4*b* above, however with an opposite twisting direction of the outer portion 113. As for the embodiment of FIGS. 1*a*-4*b* with the "C" shape 180° twisting region, the outer portion (113) is twisted away from the plane of the main body portion (112) and out of the paper. However, by contrast, for the present embodiment, the "S" shape 180° twisting region, the outer portion (113) is twisted towards and into the paper.

As shown in FIGS. 12*a*-12*d*, there is shown another embodiment of a balance spring (121) having a main body (122) and an outer portion (123). The original balance spring (121) is shown before twisting is shown in FIG. 12*a*, which has a twisting region and one bending region. After the twisting and raising the outer portion (123) away from and then towards the plane of the paper, the outer portion (123) is bent over the main body portion (122) to form the shape of overcoil balance spring.

As will be appreciated by those skilled in the art, there exist other and alternate embodiments of balance springs, whereby the arrangement of the outer portion with respect to the main body portion may vary, as well as the mode of movement of the outer portion away from and over the main body portion of the balance spring, so as to form an overcoil portion and thus an overcoil balance spring, in addition to the exemplary embodiments sa depicted and described, without departing from the scope of the invention. The present invention provides a balance spring having the following advantages:

(i) precision manufacturing;

(ii) mass concentricity compensation (iii) unitary construct and no additional portions required to be affixed to the spring (iv) possible for constant cross-section area due to absence of joining members, thus:

a. constant second moment of area thus more uniform stiffness, b. constant cross sectional area thus ease of thermal compensation oxide by layer utilization.

We claim:

1. A method of producing unitary formed silicon balance spring having an overcoil portion for regulation of a mechanical timepiece, said method including the steps of:

(i) providing a silicon balance spring having a main body portion, and an outer portion for formation as an overcoil portion, wherein the outer portion extends radially outward from an outermost turn of the main body portion, and wherein said main body portion and said outer portion are integrally formed from a silicon based material and are formed in a co-planar configuration;

(ii) moving said outer portion in a direction relative to and out of the plane of said main body portion, and in a direction towards over said main body portion and towards the plane of the main body portion; and (iii) providing a stress relaxation process to the balance spring so as to relieve internal stresses induced within the balance spring from step (ii);

wherein upon movement of said outer portion into the plane of said main body portion, the outer portion is located in an overcoil configuration relative to said main body portion.

2. A method according to claim 1, wherein the movement of said step (ii) is effected incrementally in the direction towards over said main body portion and towards the plane of the main body portion.

3. A method according to claim 2, wherein between or during incremental steps of step (ii), the step (iii) is effected.

4. A method according to claim 1, wherein an oxidation step of at least the outer portion is effected prior to effecting step (ii), so as to remove or minimize stress concentration defects.

5. A method according to claim 4, wherein said oxidation step includes exposure to a hydrogen fluoride solution.

6. A method according to claim 1, further including the step of twisting the outer portion through at least one 180° turn, wherein said at least one 180° turn is about the longitudinal axis of said outer portion, and where the outer portion is twisted in a region adjacent the outer turn of said main body portion.

7. A method according to claim 1, wherein said stress relaxation process is performed at a temperature of greater than 500° C., more preferably at a temperature of greater than 700° C., and more preferably at a temperature of greater than 1100° C.

8. A method according to claim 1, wherein said stress relaxation process is performed for at least 10 hours, more preferably for at least 20 hours, and more preferably for at least 30 hours.

9. A method according to claim 1, wherein said balance spring is formed by way of a micro-fabrication technique.

10. A method according to claim 1, wherein said balance spring is formed by way of a deep reactive ion etching (DRIE) technique.

11. A unitary formed silicon balance spring having an overcoil portion, when formed according to the method of claim 1.

12. A unitary formed silicon balance spring according to claim 11, wherein said balance spring is sized for a timepiece.

* * * * *